US005283985A

United States Patent [19]

Browning

[11] Patent Number: 5,283,985

[45] Date of Patent: Feb. 8, 1994

[54] EXTREME ENERGY METHOD FOR IMPACTING ABRASIVE PARTICLES AGAINST A SURFACE TO BE TREATED

[76] Inventor: James A. Browning, c/o Draco, P.O. Box 6, Hanover, N.H. 03755

[21] Appl. No.: 45,229

[22] Filed: Apr. 13, 1993

[51] Int. Cl.[5] ..... B24C 1/00

[52] U.S. Cl. ..... 51/319; 51/322; 51/439

[58] Field of Search ..... 51/319, 320, 321, 322, 51/439, 427

[56] References Cited

U.S. PATENT DOCUMENTS 2,990,653 7/1961 Browning ..... 51/439
3,854,997 12/1974 Peck et al. ..... 51/439

FOREIGN PATENT DOCUMENTS 0423619 9/1974 U.S.S.R. ..... 51/439
0614725 12/1948 United Kingdom ..... 51/439

*Primary Examiner*—Robert A. Rose

*Attorney, Agent, or Firm*—Sughrue, Mion, Zinn, Macpeak & Seas

[57] ABSTRACT

A fuel and oxygen mixture is combusted within an internal burner combustion chamber at temperatures ranging from 250 psi to 1,000 psi. The products of combustion are directed through a restricting nozzle throat and a supersonic expansion nozzle section into an elongated duct formed by an extended nozzle length. Abrasive particles are introduced into the supersonic flow jet stream near the entrance to the elongated duct to accelerate the particles to extreme velocity, with the combustion pressure maintained sufficiently high to limit the jet stream temperature to that which is insufficient throughout the elongated duct to raise the particle temperatures to the plastic point of the particle material. The temperature of the supersonic gas flow through the elongated duct may be reduced by the introduction of a cooling flow into the jet stream beyond the flow-restricting nozzle throat. The cooling flow may be a flow of water or other liquid coolant or cool compressed air.

7 Claims, 1 Drawing Sheet

EXTREME ENERGY METHOD FOR IMPACTING ABRASIVE PARTICLES AGAINST A SURFACE TO BE TREATED

FIELD OF THE INVENTION

This invention relates to sand blasting surfaces by impacting abrasive particles against such surface, and more particularly to the use of an internal burner in which an oxy-fuel mixture is combusted at very high pressure, with the abrasive particles for sandblasting introduced to the expanded gas products of combustion and accelerating such particle in an extended nozzle length downstream of the particle introduction point into expanded gases at near atmospheric pressure.

BACKGROUND OF THE INVENTION

In my U.S. Pat. No. 2,990,653, an application of rocket technology is employed to increase particle velocity in sandblast cleaning application by the use of internal burners powered by compressed air and a hydrocarbon fuel. The use of pure oxygen as the oxidant in a fuel and oxygen mixture fed to the combustion chamber of the internal burner has the severe advantage of melting some types of abrasives during particle transit through the gun, conventionally introduced upstream and of the internal burner combustion chamber. For this reason, pure oxygen could not be used as the oxidant source.

More recently, I have found that by using extremely high combustion pressures and introducing abrasive particles in the expanded gas, which has a temperature significantly below that of the products of combustion exiting from the combustion chamber, such allows the practical use of oxy-fuel internal burners for blast cleaning applications. This led to later work in similar air-fuel devices, in which the abrasive was added just upstream of the restricting nozzle passage, thereby eliminating the transit of the particles through the combustion chamber as exemplified by my U.S. Pat. No. 4,540,121.

SUMMARY OF THE INVENTION

The present invention is directed to a method of impacting abrasive particles against a surface to be treated, using an internal burner by introducing the abrasive particles into the supersonic jet stream after expansion of the product of combustion gases from the internal burner to nearly atmospheric pressure from very high pressures of the combustion chamber, and by causing the abrasive particles in their supersonic jet stream carrier gas to travel through an extended nozzle length, which nozzle length is long enough to accelerate the particles to much greater impact velocity than heretofore possible using either conventional compressed air sandblasting equipment or the air-fuel internal burner devices of my earlier patents, discussed above.

BRIEF DESCRIPTION OF THE DRAWING

The single figure is a cross-sectional view of an internal burner employing the method forming a preferred embodiment of the invention.

DESCRIPTION OF THE PREFERRED EMBODIMENT

Figure 1:
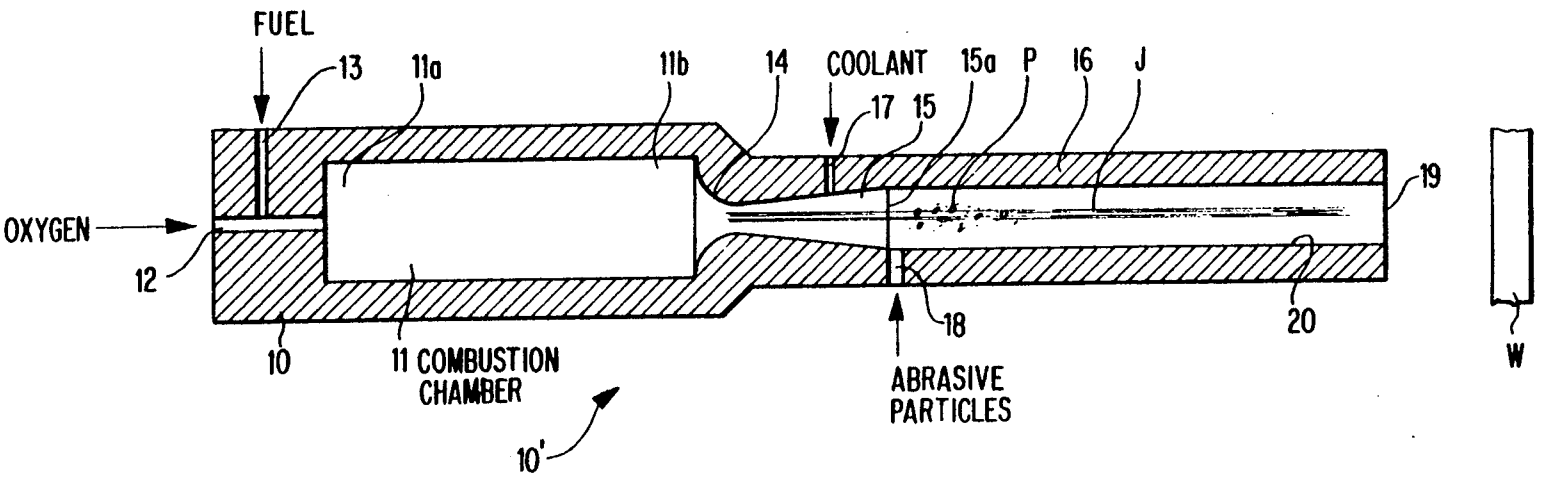

FIG. 1 is a cross-sectional view of an internal burner suitable for practicing the method of this invention. The internal burner indicated generally at 10' is comprised of a unitary metal, main body 10 of elongated cylindrical form which includes an axially positioned combustion chamber 11 of elongated cylindrical form, which is open at an upstream end 11*a*, to a small diameter axial bore or oxygen supply duct 12 receiving a source of oxygen under pressure as indicated by the labeled arrow. A fuel and oxygen mixture is effected by feeding fuel as indicated by the arrow labeled FUEL through a radial passage 13, which is at right angle to axial passage 12 and which intersects the same. The fuel and air mixture enters the combustion chamber and is combusted by a spark ignition device (not shown) or other conventional means. The downstream end 11*b* of the combustion chamber opens directly to a restricting nozzle throat 14 leading to a supersonic expansion nozzle section 15 of relatively short length. The internal burner 10' terminates in an integral, extended nozzle length 16 which is two, three or more times the combined length of the restricting nozzle throat 14 and the supersonic expansion nozzle section 15. Abrasive particles P from a source identified by the arrow labeled, ABRASIVE PARTICLES are fed through radial passage 18 within the sidewall of the extended nozzle length 16, permitting the feed of the abrasive into the jet stream after expansion of the products of combustion to near atmospheric pressure and after a significant temperature drop within the jet stream. The particles P enter a constant diameter bore 20 within the extended nozzle length 16 prior to exiting from the exit or outlet end 19 of the extended nozzle length. The extended nozzle length 16 is shown as integral with the metal cylindrical body 10. Typically the extended nozzle length may be a replaceable nozzle tube of extremely hard metal. A radial passage 17 is provided within the supersonic expansion nozzle section 15, upstream of its exit end 15*a*, at the junction between the supersonic expansion nozzle section 15 and the extended nozzle length 16. As indicated by the arrow labeled COOLANT, water or other coolant may be introduced under pressure through the small diameter radial passage 17 into the expanding jet stream J emanating from the combustion chamber 11.

If the oxy-fuel internal burner 10' of FIG. 1 were to be operated at conventional oxygen pressures, for instance, at 125 psi combustion pressure with a suitable supply of fuel through radial passage 13, the expanded jet velocity through the extended nozzle length 16 would be about 6,920 ft/sec, and the expanded jet J would be at a temperature of approximately 4,285° F. Although such apparatus operating under these parameters, and given a long enough acceleration duct (extended nozzle length 16), would speed abrasive particles P to velocities of 2,000 ft/sec, many of the smaller particles would have melted in standard nozzle length 16, leading to the plugging of tube 16 and causing the equipment to be rendered inoperable.

From a recent program, which I conducted, directed to the use of oxy-fuel internal burners operating at extremely high pressure, I have found that long nozzle ducts, said extended nozzle length 16, may be incorporated with the apparatus at the exit end of the supersonic expansion nozzle section 15 without fusing even the smallest abrasive particles. I have found that this beneficial result arises from the large expansion ratio of the hot products of combustion gases passing from the combustion chamber to atmospheric pressure. Calculated examples of the degree of jet J cooling obtained are given for 600 psi and 1,200 psi combustion chamber pressures as examples of the present invention, using a constant $K=c_p c_v=1.1$ and data from the publication "Gas Tables" by J. H. Keenan and J. Kaye, published by John Wiley & Sons, Inc. of New York, 1948.

As a first example, for 600 psi combustion pressure with a jet temperature of 3,700° F., a jet velocity of 8,580 ft/sec results.

For the second example where the combustion pressure within the combustion chamber is doubled to 1,200 psi, the jet temperature becomes 3,400° F. at 9,700 ft/sec at the exit 15*a* of the supersonic expansion nozzle section 15. From this (comprising operation of 1,200 psi against that at 125 psi), I have learned that lowering jet temperature to about 900° F. coupled with a 1,500 ft/sec increase in jet velocity permits a much longer acceleration passage by way of an increased extended nozzle length 16 beyond the exit 15*a* of the expansion nozzle section 15 for a given type abrasive, without the smallest particles thereof reaching fusion temperature.

I have determined that where the abrasive particles P have a particularly low melting point, it is preferable to introduce a small flow of coolant such as water, air or other cooling fluid into the expanded jet J to reduce the jet temperature sufficiently to prevent during particle transit over the extent of the nozzle bore 20 of the extended nozzle length 16 from the abrasive particle supply passage 18 to the exit end 19 of that nozzle length, without fusion of particles to the interior of the bore and the closing off of the nozzle bore. The coolant is conveniently introduced upstream of and prior to particle P introduction as shown in FIG. 1. The process of the present invention effects acceleration of the particles to extremely high velocity by the use of extended nozzle length 16 or accelerator ducts of up to 2 feet or more in length. For reactant flows of 1,800 SCFH of oxygen with six gallons of fuel oil per hour, the mass flow of the products of combustion (jet stream J) is about 190 pounds per hour. Assuming a jet speed of 8,000 ft/sec and an abrasive particle P flow of 100 pounds per hour, momentum considerations show that the particles P (under perfect conditions) reach a velocity of nearly a mile per second. Such extreme acceleration is probably not practical. It is reasonable to assume, however, an impact velocity against the workpiece W being cleaned, downstream of and in the path of the particles exiting the outlet of nozzle length 10, of 2,000 ft/sec; a value five times greater than that achieved by conventional cold compressed sandblasting.

The impact energy increase provided by combusting the oxidant (oxygen) at greatly elevated pressure is $5^2=25:1$. Each particle accomplishes manyfold that of the low temperature system. Where the oxygen costs are greater than compressed air costs, the savings in costs of the amount of abrasive required may result in a net savings using the method of the invention. The method of this invention is particularly competitive where the surface cleaning involves extremely difficult-to-remove materials such as epoxy coatings, thick mill scale and the like. Typically, the abrasive particles employed in the method of this invention are sand and steel shot. The bore diameter 20 of the extended nozzle length 16 may range from 16 inches to 36 inches.

While the invention has been described in terms of several examples, the invention is not limited thereto and changes may be made in the operating parameters without departing from the spirit of the invention, which is limited only to the extent of the claims appended hereto.

What is claimed is:

1. A method of abrasive blasting a surface to be cleaned or treated comprising supplying an oxy-fuel mixture to an internal burner combustion chamber open at a downstream end to, in order, a restricting nozzle, a restricting nozzle throat, a supersonic expansion nozzle section, and an extended nozzle length forming an elongated duct by combusting said oxygen and fuel mixture within said combustion chamber, producing a flow of high-temperature products of combustion to supersonic velocity through said restricting nozzle throat and said supersonic expansion nozzle section, forming a jet stream and maintaining the supersonic flow through the elongated duct, introducing abrasive particles into the supersonic flow in the vicinity of said elongated duct to thereby accelerate the particles to extreme velocity, and maintaining the combustion pressure sufficiently high to limit the jet stream temperature passing through the elongated duct to a level which is insufficient to raise the temperature of the particle to the plastic point of the particles.

2. The method of claim 1, wherein the chamber pressure is maintained above 250 psi.

3. The method of claim 1, wherein the chamber pressure is maintained above 500 psi.

4. The method of claim 1, wherein the chamber pressure is maintained above 1,000 psi.

5. The method of claim 1, further comprising the step of reducing the temperature of the supersonic gas flow through said elongated duct by cooling the jet stream beyond the flow-restricting nozzle.

6. The method as claimed in claim 5, wherein said cooling step comprises injecting a flow of water into the jet stream upstream of the extended nozzle length.

7. The method of claim 5, wherein said cooling step comprises injecting a flow of compressed air into the jet steam upstream of the extended nozzle length.

* * * * *